US009283471B2

(12) United States Patent
Strzelewicz et al.

(10) Patent No.: US 9,283,471 B2
(45) Date of Patent: Mar. 15, 2016

(54) METHOD AND A DEVICE FOR ELECTROMECHANICAL SELECTION OF AN ELEMENT FROM A PLURALITY OF ELEMENTS

(71) Applicant: GAME TECHNOLOGIES SPOLKA AKCYJNA, Poznan (PL)

(72) Inventors: Patryk Strzelewicz, Poznan (PL); Michal Bak, Murowana Goslina (PL); Tomasz Watorowski, Bydogoszcz (PL)

(73) Assignee: GAME TECHNOLOGIES SPOLKA AKCYJNA, Poznan (PL)

( * ) Notice: Subject to any disclaimer, the term of this patent is extended or adjusted under 35 U.S.C. 154(b) by 152 days.

(21) Appl. No.: 13/777,182

(22) Filed: Feb. 26, 2013

(65) Prior Publication Data

US 2013/0319112 A1 Dec. 5, 2013

(30) Foreign Application Priority Data

Jun. 4, 2012 (EP) ..... 12170707

(51) Int. Cl.
*A63F 9/04* (2006.01)
*A63F 9/24* (2006.01)

(52) U.S. Cl.
CPC ..... *A63F 9/04* (2013.01); *A63F 9/0468* (2013.01); *A63F 2009/2447* (2013.01)

(58) Field of Classification Search
CPC .. A63F 9/0468; A63F 9/04; A63F 2009/2447
USPC ..... 73/493
See application file for complete search history.

(56) References Cited

U.S. PATENT DOCUMENTS

| | | | | |
|---|---|---|---|---|
| 4,034,988 | A * | 7/1977 | Goldner et al. | 463/22 |
| 4,858,931 | A * | 8/1989 | McKechnie | 463/22 |
| 6,220,594 | B1 * | 4/2001 | Peng | 273/146 |
| 6,331,145 | B1 * | 12/2001 | Sity et al. | 463/22 |
| 6,394,903 | B1 * | 5/2002 | Lam | 463/22 |
| 7,017,905 | B2 * | 3/2006 | Lindsey | 273/146 |
| 7,334,791 | B2 * | 2/2008 | Lindsey et al. | 273/146 |
| 7,463,997 | B2 * | 12/2008 | Pasolini et al. | 702/160 |

(Continued)

FOREIGN PATENT DOCUMENTS

CN 101 898 037 A 12/2010

OTHER PUBLICATIONS

European Search Report of EP Application No. 12170707.9 dated Oct. 10, 2012.

*Primary Examiner* — Freddie Kirkland, III
(74) *Attorney, Agent, or Firm* — Browdy and Neimark, PLLC

(57) ABSTRACT

A device for electromechanical selection of an element from a plurality of elements, according to present invention has a housing in a form of a body of a regular shape, enabling the device to take N rest positions, where N is a natural number. Each of the rest positions corresponds to one element selected from N elements, wherein the device is adapted to electrically and optically transmit data regarding trajectory of its movement and rest positions, including indications of an accelerometer connected to a position analysis and identification module. At least one proximity sensor and at least one magnetometric sensor is further placed inside the housing, and filters are connected on the signal path between the accelerometer and the sensors and position analysis and identification module. The present invention is also directed to the method of electromechanical selection of an element from a plurality of elements.

17 Claims, 4 Drawing Sheets

(56) References Cited

U.S. PATENT DOCUMENTS

| | | | | |
|---|---|---|---|---|
| 8,299,686 | B2 * | 10/2012 | Yamamoto et al. | 310/338 |
| 8,490,971 | B2 * | 7/2013 | Ouwerkerk et al. | 273/146 |
| 8,920,345 | B2 * | 12/2014 | Greenberg et al. | 600/595 |
| 2005/0215312 | A1 * | 9/2005 | Tresser et al. | 463/22 |
| 2009/0104976 | A1 | 4/2009 | Ouwerkerk et al. | |
| 2010/0032896 | A1 | 2/2010 | Berlee et al. | |
| 2010/0145236 | A1 * | 6/2010 | Greenberg et al. | 600/595 |
| 2013/0241376 | A1 * | 9/2013 | Chevalier et al. | 312/223.1 |

* cited by examiner

METHOD AND A DEVICE FOR ELECTROMECHANICAL SELECTION OF AN ELEMENT FROM A PLURALITY OF ELEMENTS

CROSS-REFERENCE TO RELATED APPLICATIONS

This application and claims priority to EP 12170707.9 filed 25 Jul. 2012, the entire contents of which is hereby incorporated by reference.

FIELD OF THE INVENTION

The present invention relates to a method and a device for electromechanical selection of an element from a plurality of elements, said device having a housing in a form of a body of a regular shape, enabling the device to take N rest positions, where N is a natural number, and where each rest position corresponds to one element selected from among the N elements.

BACKGROUND OF THE INVENTION

The methods and devices of this type are used, for example, in games—for generating random elements from a plurality of elements. Drawing an element is performed by forcing a random move of the device, followed by readout of the result from the device being in a rest position. The simplest example of a purely mechanical random result generating device is a cubic die; however, devices of different shapes, having from two to one hundred rest positions, are known in the state of the art.

A wireless cubic die comprising a position detector and a transmitter for transmitting die position data to the receiver is known from US patent description No. US 2009/0104976 (Philips Intellectual Property & Standards). The position detector comprises piezoelectric sensors with cantilevers or a movable magnet combined with a sensing coil. A disadvantage of this solution is the limited possibility of reading the parameters of the movement of the body, especially in the case of lack of contact with a surface, as well as the limited angle resolution.

Electronic dice for computer games, having n faces, where n is greater than 2, and n−1 position sensors, is known from the patent No. U.S. Pat. No. 6,331,145 (Cibro Technologies Ltd). The sensors comprise RFID transponders or optical sensors, wherein the face lying on the surface is identified. A drawback of this solution is, again, the limited possibility of reading the movement parameters of the body, especially when it does not contact the surface. Another drawback are technology-related complications in the housing of multi-face dice. This type of solution cannot be applied to dice having two stable positions.

Polish patent application No. P.394858, in the name of the originator of the present invention, discloses an application of an accelerometer for observing the trajectory of movement of the body and reading its rest position.

None of the said solutions provides for the possibility to monitor the spinning of the device's body while in the air, along the lines of the gravitational field forces. Also the accuracy of surveillance of the movement of the device only by means of an accelerometer is insufficient in some applications, especially in the case of games.

SUMMARY OF THE INVENTION

A device for electromechanical selection of an element from a plurality of elements, having a housing in a form of a body of a regular shape, enabling the device to take N rest positions, where N is a natural number, and where each of the rest positions corresponds to one element selected from N elements, wherein the device is adapted to electrically and optically transmit data regarding trajectory of its movement and rest positions, including indications of an accelerometer connected to a position analysis and identification module, stands out in that at least one proximity sensor and at least one magnetometric sensor is further placed inside the housing and filters are connected on the signal path between the accelerometer and the sensors and position analysis and identification module.

In a preferred embodiment the the signal path between the accelerometer and the position analysis and identification module is split into at least two branches.

Preferably, on at least one of the branches of the signal path between the accelerometer and the position analysis and identification module a low-pass filter is connected.

Advantageously, on at least one of the branches of the signal path between the accelerometer and the position analysis and identification module a high-pass filter is connected.

Preferably, on at least one of the branches of the signal path between the accelerometer and the position analysis and identification module a band-pass filter is connected.

In another preferred embodiment, a low-pass filter is connected on the signal path between at least one proximity sensor and the position analysis and identification module.

Preferably, a low-pass filter is connected on the signal path between at least one magnetometric sensor and the position analysis and identification module.

Advantageously, the proximity sensor constitutes a detector of changes of the capacitance.

A method of electromechanical selection of an element from a plurality of elements, by means of a device having a housing in a form of a body of a regular shape, enabling the device to take N rest positions, where N is a natural number, and where each of the rest positions corresponds to one element selected from N elements, wherein the device is adapted to electrically and optically transmit data regarding trajectory of its movement and rest positions, including indications of an accelerometer connected to a position analysis and identification module, stands out in that the changes in the magnetic field surrounding the housing of the device are measured by means of at least one magnetometric sensor placed inside the housing, and approach of the housing of the device to the surrounding elements is detected by at least one of the proximity sensors, and electrical filtration is applied to the output signals of at least one accelerometer and at least one magnetometric and proximity sensor prior to transmitting to the position analysis and identification module.

Preferably, the accelerometer output signal is subjected to low-pass filtration.

In a preferred embodiment, the accelerometer output signal is subjected to high-pass filtration.

Preferably, the accelerometer output signal is subjected to band-pass filtration.

Advantageously, the magnetometric sensor output signal is subjected to low-pass filtration.

Preferably, the proximity sensor output signal is subjected to low-pass filtration.

Preferably, the approaching of the device's housing to the surrounding elements is detected by means of measuring changes of the capacitance.

The device according to the present invention is used for random selection of elements in computer, TV and communication devices, for computer and board games, and for the purpose of generating random results in training devices.

BRIEF DESCRIPTION OF DRAWINGS

The invention will be described in more detail with reference to the attached drawings, showing some embodiments of the present invention, where.

DETAILED DESCRIPTION OF THE EMBODIMENTS

Figure 1:
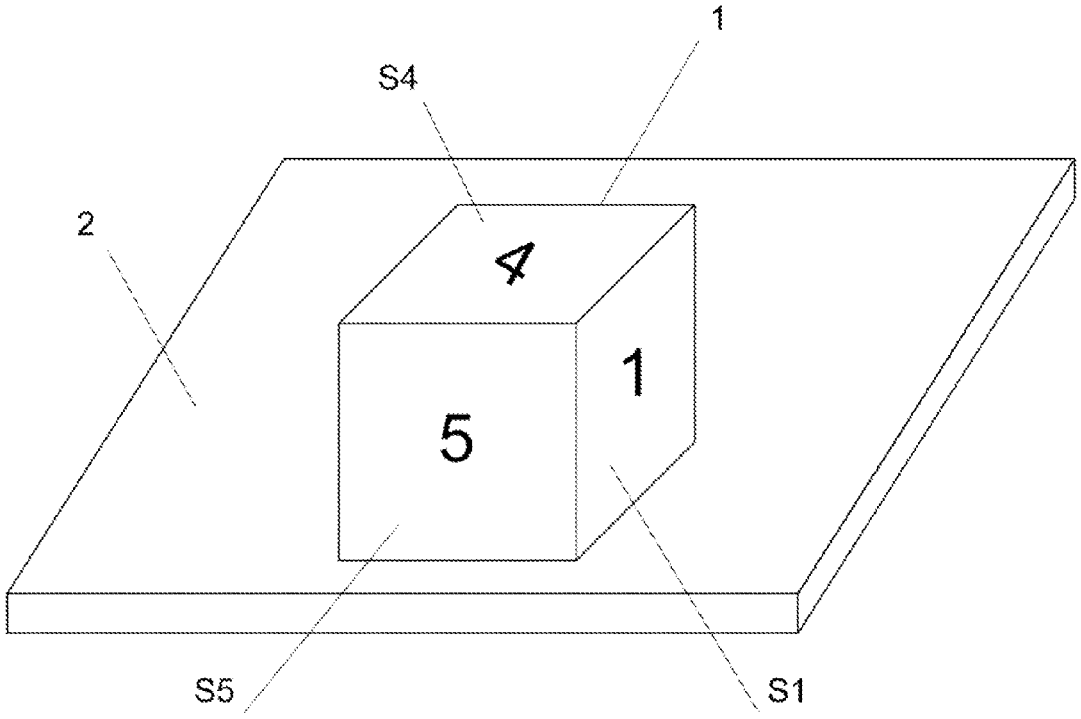
FIG. 1 shows a schematic view of the device.

FIG. 1 shows a schematic view of the device having a housing 1 in a form of a body of a regular shape, having N=6 faces, comprising an electronic circuit allowing to identify the housing's position relative to a horizontal surface 2. The faces of the housing 1 are marked S1-S6.

Figure 2:
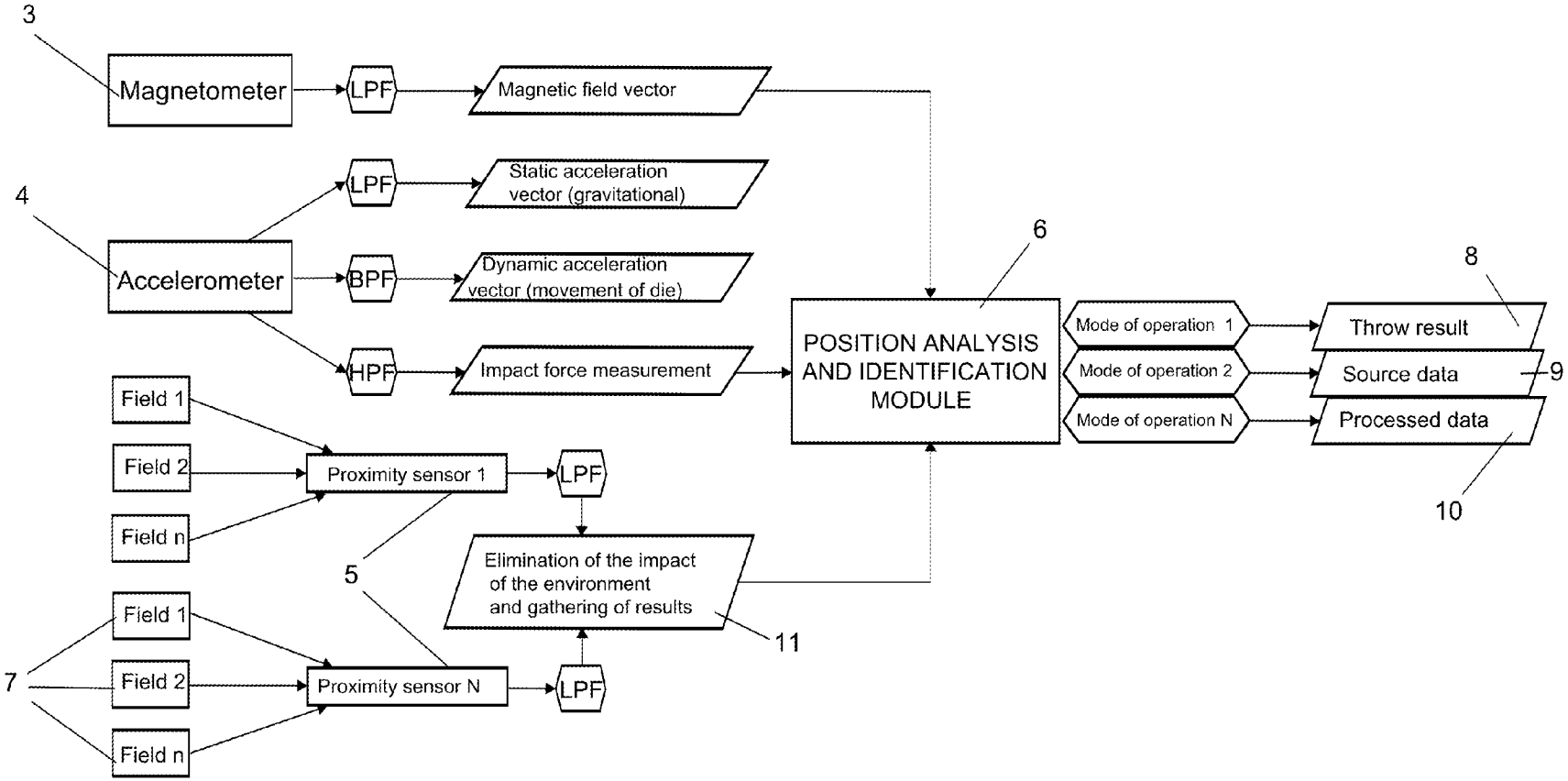
FIG. 2 shows a block diagram view of the flow of signals from sensors within the system.

Proximity sensors, magnetometer 3, accelerometer 4 as well as signal processing and power supply circuits (not shown) are placed inside the housing 1. The task of the sensors, magnetometer and accelerometer is to monitor the parameters of the process of a throw. An analysis of the parameters allows to define the basic facts regarding a throw, i.e. its result, duration and correctness. The flow of signals from the sensors within the device is illustrated in FIG. 2.

Each proximity sensor 5 (provided as a capacitance sensor in one embodiment) collects the reading results from several fields 7 (three fields shown in the embodiment, but additional fields are possible). Following processing the results, the analysis module 6, depending on the mode of operation, either transmits the result of a throw 8, or source data 9, which are transmitted by means of a communication module to a receiver for analysis, for example, in order to identify the type of gestures applied to the body, or partially processed data 10, may be many, depending on the needs.

An user throws the body in order to begin the generation of a result. Then the position analysis and identification module 6 collects and processes the data on the force and length of the throw in order to determine whether the throw was correct (whether the device remained in motion for a suitable period of time, and whether it turned around its xyz axes to a sufficient extent).

A three-axis accelerometer 4 is applied to determine whether the device is in motion, and to provide information on the result of the throw. This allows to unequivocally determine the position of the device relative to the Earth's gravitational field lines. Indications of the accelerometric sensor are collected at frequency of 400 Hz.

Collected reading results are subjected to three-way processing by means of FIR (Finite Impulse Response) filters with different frequency responses: low-pass filter LPF, band-pass filter BPF and high-pass filter HPF.

A low-pass filter LPF, with a bandwidth of 0 Hz-10 Hz, is used to recreate information about the static acceleration vector impacting the device. This vector is used to determine the result of a throw.

A band-pass filter BPS with a bandwidth of 10 Hz-300 Hz supplies information on whether or not the device is in motion.

A high-pass filter HPF with low edge frequency of 300 Hz is used to detect impacts (hits against a surface onto which the housing is thrown in order to generate a result).

In the solution according to the invention, a multi-section proximity sensor 5 is applied. This enables monitoring and pinpoint the approaching the housing 1 of the device by organic matter (e.g. hand of a user). The purpose behind monitoring such approaching is to provide reliable information on the commencement of a throw. The necessity to use proximity sensors is dictated by the nature of the throw process. Measurements taken by means of an accelerometer are insufficient to unequivocally determine the commencement of a throw, as they provide information only on a change of the acceleration vector, but not on the releasing an item from the palm of the hand.

The proximity sensor 5 provides information affected by a noise coming from the environment in which the device is being used, as well as internal interferences resulting from the thermal and voltage drift related to the changes in the power supply voltage. In order to recreate valuable information, the sensor's signals are processed by means of a set of algorithms and software filters.

subsequent readings of the capacitance of the proximity sensor's 5 are collected at frequency of 20 Hz. The read-out values are transmitted to the input of the FIR low-pass filter. The purpose of the filtration is to remove the interferences generated by the other electronic components used in the device.

Filtered signal is subjected to an analysis by means of an adaptation algorithm, compensating the impact of the changes of environment. The purpose of the algorithm is to diversify between the changes in the capacity appearing in the course of each throw from changes resulting from, for example, using different surfaces 2 on which a game takes place. The algorithm provides information on whether or not the housing 1 of the device has been gripped.

Another stage of processing consists in grouping 11 the data processed by the adaptation algorithm into the sets. If the information on gripping the housing appears a number of times exceeding a certain predetermined value, the fact of grip detection is stated. The purpose of grouping 11 and counting is to eliminate the existence of transients (lack of unequivocal grounds to determine that the housing has been gripped or released).

An additional element supporting the monitoring of the sampling process is a magnetometer 3. This element provides information on the position of the devices relative to the Earth's magnetic field, what allows to determine whether or not the device has turned around any of the symmetry axes. An advantage of this solution is its insensibility to impact, which significantly disturbs the work of the accelerometer 4.

The magnetometric sensor 3 provides an additional level of freedom to the position determining algorithms (monitoring turns around an axis parallel to the line of the gravitational field, supervised by the accelerometer 4).

Indications of the magnetometric sensor 3 are collected at frequency of 100 Hz, and are subsequently subjected to low-pass filtering in order to eliminate own noise of the magnetometer 3, as well as an environment noise.

Figure 3:
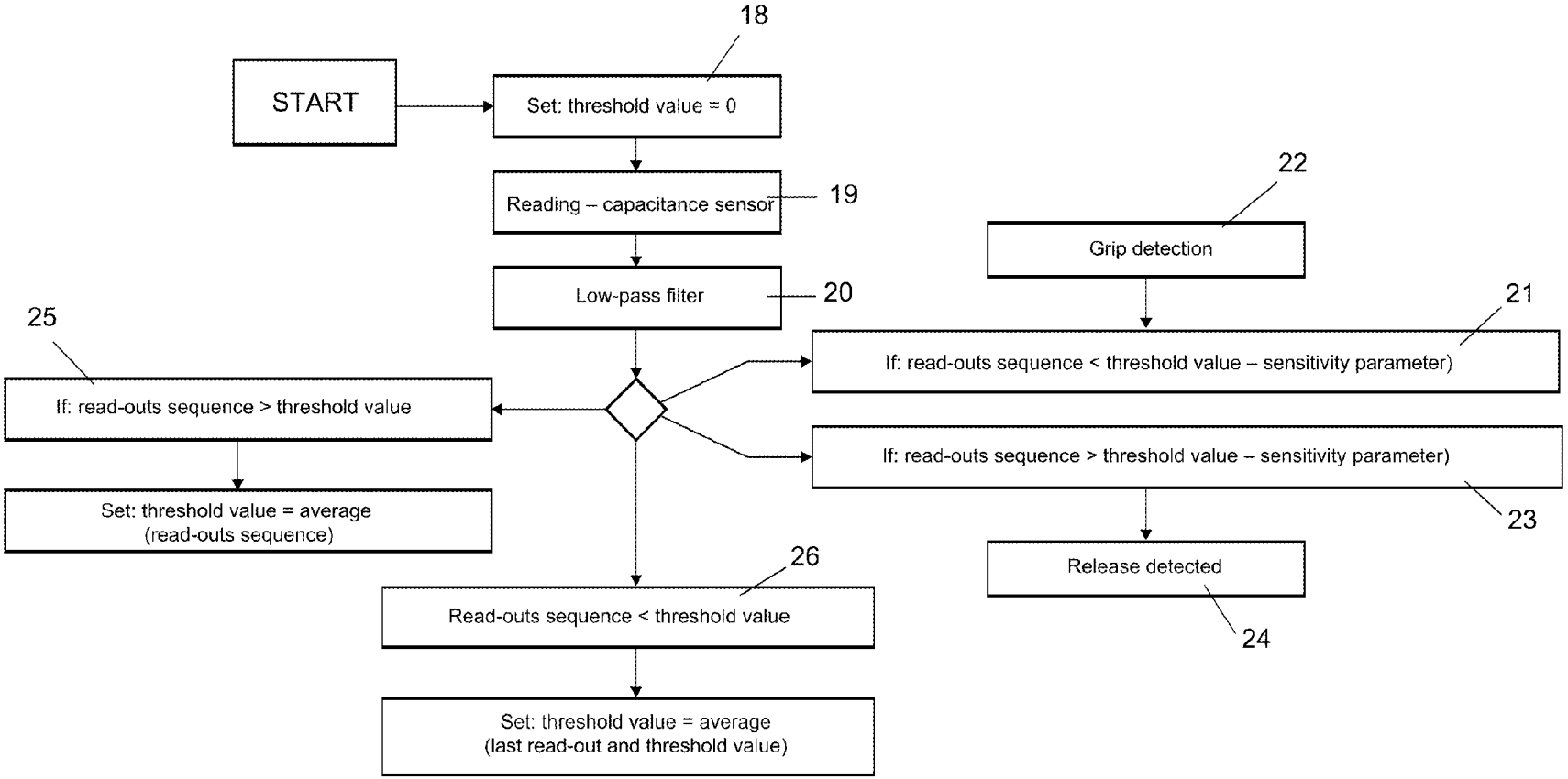
FIG. 3 presents the flowchart illustrating the method of monitoring a gripping and releasing the device.

FIG. 3 presents a flowchart related to the method of monitoring of the gripping and releasing of the housing 1 of the device, based on comparing the values from the proximity sensor 5 with the calculated threshold value.

In the first step, a variable storing the threshold value is initiated 18 by the value of 0. The next step consists in an ongoing monitoring indications 19 of the proximity sensor 5, subjected to low-pass filtration 20.

If a sequence of at least 16 readings exceeding 25 the threshold value is detected, an arithmetic mean of the registered sequence is assigned the variable storing the threshold value.

If a sequence is detected of 100 read-outs of a value lower 26 than the threshold value, then the threshold value is assigned a value constituting an arithmetic mean of the present threshold value and the last value of the sequence.

If a sequence (of a predetermined length) is detected of values lower than the threshold value, decreased by the sensitivity determining parameter 21, it is decided that an occurrence of gripping 22 of the housing has taken place.

If a sequence of values higher than the threshold value is detected, decreased by the sensitivity determining parameter 23, it is decided that an occurrence of releasing 24 of the housing has taken place.

Figure 4:
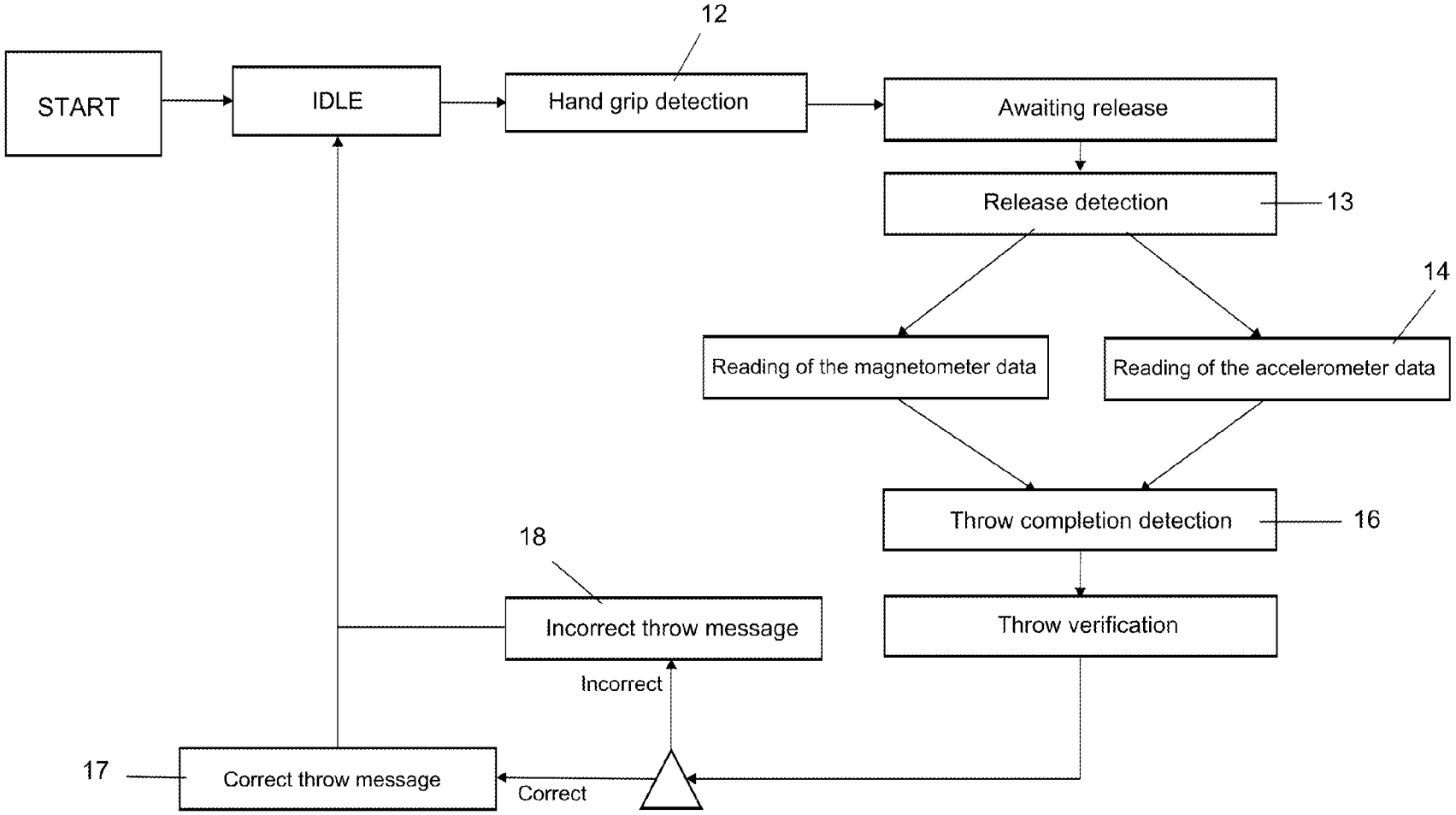
FIG. 4 presents flowchart illustrating a method of verification of a throw.

The method of operation of the device, i.e. the method of verification of a throw is illustrated in the flowchart on FIG. 4.

During the first step, the device expects detection of an occurrence of gripping 12 of the housing 1 by a user. Following the detection of the said occurrence, the device passes to the waiting state.

The waiting state lasts until an occurrence of releasing 13 of the device from the palm of the hand is detected, following which the device passes to the monitoring state. The instant the device is released by a user is interpreted as the commencement of a throw, and results in resetting the meters and calculating the time parameters of the result generation.

The next state consists in the monitoring 14 indications of the accelerometer. A throw is deemed incomplete until changes in the dynamic acceleration of the housing 1 are observed. The values of the dynamic acceleration are calculated by means of band-pass filtration of non-processed values from the accelerometer 4. The indications of the magnetometer 3 are monitored 15 in order to verify whether the device has turned at least 90 degrees around any of the symmetry axes of the housing 1.

In the case of detection of a time slot of a predetermined length during which the values of the dynamic acceleration of the housing 1 are lower than the anticipated value, the device passes to the state of throw completion procedure.

During the throw completion procedure, all throw parameters are verified. Also the readouts of the meters determining the time parameters of a throw are read. If the total throw time is shorter than expected, the user is informed 18 that the throw was incorrect. The values read from the accelerometer 4 are used to determine which face of the housing 1 rests on the surface. If the readouts show a deviation from horizontal surface greater than a predetermined value, the user is informed 18 that the throw was incorrect. If no turn of at least 90 degrees around any of the symmetry axes is detected, the user is informed 18 that a throw was incorrect.

If all criteria of the correct throw have been met, the user is informed 17 that the result generation process was completed successfully, and the device gets back to the idle state.

The solution according to the present invention allows to efficiently eliminate any disturbance occurring during electromechanical result generation. In the case of entertainment-related applications, the device according to the present invention allows to increase the attractiveness of games by combining classic and computer technologies, and prevents any attempts at manipulating the result.

It is obvious, that the purpose of description of the above embodiment serves only to illustrate the solution according to the present invention and that it does not limit the scope of protection in any way.

A person skilled in the art will readily notice that, for example, the frequency of readouts, the edge frequencies of the filters, the number of sensors, fields, etc. may be changed without compromising the scope of the protection.

The invention claimed is:

1. A device for electromechanical selection of an element from a plurality of elements, comprising a housing in a form of a body of a regular shape, enabling the device to take N rest positions, where N is a natural number, and where each of the rest positions corresponds to one element selected from N elements, wherein the device is adapted to electrically and optically transmit data regarding trajectory of movement and rest positions of the device, including indications of an accelerometer connected to a position analysis and identification module, the device comprising at least one magnetometric sensor, at least one proximity sensor placed inside the housing, and filters connected on the signal path between the accelerometer and the sensors and position analysis and identification module, and the position analysis and identification module is arranged to detect an occurrence of gripping and/or releasing of the housing of the device based on a value from the at least one proximity sensor and a calculated threshold value.

2. The device as claimed in claim 1, wherein the signal path between the accelerometer and the position analysis and identification module is split into at least two branches.

3. The device as claimed in claim 2, further comprising a low-pass filter connected on at least one of the branches of the signal path between the accelerometer and the position analysis and identification module.

4. The device as claimed in claim 2, further comprising a high-pass filter connected on at least one of the branches of the signal path between the accelerometer and the position analysis and identification module.

5. The device as claimed in claim 2, further comprising a band-pass filter connected on at least one of the branches of the signal path between the accelerometer and the position analysis and identification module.

6. The device as claimed in claim 2, further comprising a low-pass filter connected on the signal path between at least one proximity sensor and the position analysis and identification module.

7. The device as claimed in claim 2, further comprising a low-pass filter connected on the signal path between at least one magnetometric sensor and the position analysis and identification module.

8. The device as claimed in claim 1, wherein the proximity sensor comprises a detector of changes of the capacitance.

9. A method of randomly selecting elements and generating random results Application of the device as claimed in claim 1 to random selection of elements in computer, TV and communication devices, to computer and board games, and to the purpose of generating random results in training devices.

10. A method of electromechanical selection of an element from a plurality of elements, by a device having a housing in a form of a body of a regular shape, enabling the device to take N rest positions, where N is a natural number, and where each of the rest positions corresponds to one element selected from N elements, comprising:

electrically and optically transmitting, to a position analysis and identification module, data regarding trajectory of movement and rest positions of the device, including indications of at least one accelerometer, measuring changes in the magnetic field surrounding the housing of the device by at least one magnetometric sensor placed inside the housing, applying electrical filtration to output signals of the at least one accelerometer, the at least one magnetometric sensor, and at least one proximity sensor prior to transmitting to the position analysis and identification module, and detecting, by the position analysis and identification module, an occurrence of gripping and/or releasing of the housing of the device based on a value from the at least one proximity sensor and a calculated threshold value.

11. The method as claimed in claim 10, further comprising applying low-pass filtration to the accelerometer output signal.

12. The method as claimed in claim 10, further comprising applying high-pass filtration is applied to the accelerometer output signal.

13. The method as claimed in claim 10, further comprising applying band-pass filtration to the accelerometer output signal.

14. The method as claimed in claim 10, further comprising applying low-pass filtration to the magnetometric sensor output signal.

15. The method as claimed in claim 10, further comprising applying low-pass filtration to the proximity sensor output signal.

16. The method as claimed in claim 10, further comprising detecting the approach of the housing of the device to the surrounding elements by measuring changes of the capacitance.

17. A device for electromechanical selection of an element from a plurality of elements, comprising:

a housing in a form of a body of a regular shape, enabling the device to take N rest positions, where N is a natural number, and where each of the rest positions corresponds to one element selected from N elements, at least one magnetometric sensor to monitor at least one first parameter of a throw of the housing, at least one proximity sensor placed inside the housing to monitor at least one second parameter of the throw of the housing, an accelerometer to monitor at least one third parameter of the throw of the housing, a position analysis and identification module connected to the at least one magnetometric sensor, the at least one proximity sensor, and the at least one accelerometer, to electrically and optically transmit data regarding trajectory of movement and rest positions of the device responsive to outputs of the at least one magnetometric sensor, the at least one proximity sensor, and the at least one accelerometer, and filters connected on the signal path between the accelerometer and the at least one magnetometric and proximity sensors and the position analysis and identification module, wherein the position analysis and identification module detects an occurrence of gripping and/or releasing of the housing of the device based on a value from the at least one proximity sensor and a calculated threshold value.

* * * * *